United States Patent [19]

Schuman

[11] 4,064,933

[45] Dec. 27, 1977

[54] DEVELOPING ROLLER APPARATUS FOR REPRODUCTION MACHINES

[75] Inventor: Gordon A. Schuman, Rolling Meadows, Ill.

[73] Assignee: Dietzgen Corporation, Des Plaines, Ill.

[21] Appl. No.: 617,784

[22] Filed: Sept. 29, 1975

[51] Int. Cl.[2] ..... F28D 11/02

[52] U.S. Cl. ..... 165/89; 165/105; 219/469; 219/216

[58] Field of Search ..... 165/89, 105; 219/469–470, 216

[56] References Cited

U.S. PATENT DOCUMENTS

| | | | |
|---|---|---|---|
| 3,012,141 | 12/1961 | Thomiszer | 219/342 |
| 3,562,489 | 2/1971 | Lenk | 165/89 |
| 3,600,550 | 8/1971 | Katsumata et al. | 165/89 X |
| 3,632,984 | 1/1972 | Brownscombe | 219/469 |
| 3,640,517 | 2/1972 | Sendt | 165/105 X |
| 3,651,861 | 3/1972 | Deuring | 165/105 X |
| 3,847,208 | 11/1974 | Ollendorf | 165/105 X |
| 3,952,798 | 4/1976 | Jacobson et al. | 165/89 X |
| 3,965,334 | 6/1976 | Asselman et al. | 165/105 X |

*Primary Examiner*—Albert W. Davis, Jr.
*Attorney, Agent, or Firm*—Keil, Thompson & Shurtleff

[57] ABSTRACT

An improved developing roller for use in the development of heat-sensitive copy sheets in a reproduction machine which comprises a hollow, thin-walled heat conducting rotatable cylinder or drum having a relatively small diameter heat pipe mounted on or embedded in its inner wall and extending substantially between the ends of said cylinder in order to provide and maintain a uniform temperature across the outer surface of said cylinder in use.

2 Claims, 3 Drawing Figures

DEVELOPING ROLLER APPARATUS FOR REPRODUCTION MACHINES

Background of the Invention

There are several general types of machines for reproducing an image on a copy sheet. The type of reproduction machine with which the subject invention is concerned is the class wherein the image on the copy sheet is developed by heat.

One well known type of such machine is that using the diazo process. In this process, the copy sheet is coated with a material which includes diazo compounds. When exposed to ultraviolet light, the diazo compounds decompose into a form in which they become colorless. The portions of the sheet which are not exposed to ultraviolet light retain the diazo compound which, upon interaction with couplers also contained in the coating, produce when heated intense azoic dyes which are insensitive to light and, hence, are capable of forming permanent visible images on the copy sheet.

In such a process, a light-sensitive coating solution maybe prepared by dissolving diazo compounds together with coupling substances in water which has been weakly acidified as by means of citric, tartaric, or boric acids. The coating solution is then applied upon a sheet of material, such as paper, after which the sheet is dried to remove the water component.

When such a sheet is exposed to the action of ultraviolet light through an image-bearing layer of material that is transparent to such light, the diazo compound in the coating will be destroyed except where screened by the opaque images of the original to be copied. Thereafter, the sheet is heated in order to produce ammonia gas in the non-exposed portions of the coating and thus develop permanent dye images therein. The permanent dye in the coating will thereby form an exact reproduction on the coated sheet of the image bearing opaque portions of the original sheet.

The present invention is primarily concerned with apparatus useful in the heat development of such images on a copy sheet after it has been exposed in the presence of the image-bearing original sheet.

Brief Description of the Invention

The present invention relates to an improvement in the apparatus for heat development of copy sheets in reproduction machines. It constitutes an improvement of the apparatus described in Thomiszer U.S. Pat. No. 3,012,141, issued Dec. 5, 1961, and Brownscombe U.S. Pat. No. 3,632,984, issued Jan. 4, 1972.

The basic components of the present invention are a rotatable, hollow metal heat conducting cylinder or drum which has a series of extremely efficient heat transporting devices, known as heat pipes, mounted on or embedded in its inside wall. The wall and heat pipes are heated by a heating means to a temperature sufficient to cause the images on the copy sheet to develop as the sheet passes about the outside surface of the cylinder or drum. The heating means is preferably located within the hollow interior of the cylinder or drum in order to insure efficient heating thereof.

The present invention obviates a substantial problem found with conventional developing rollers concerning their inability to provide and maintain a uniform temperature across the entire length of the roller so as to assure even copy development. With conventional rollers, temperature differentials of as much as 8° C are typically experienced across the length of the roller. This problem is especially aggravated with larger developing machines utilizing longer rollers. When smaller copy sheets, such as 8½ inch wide sheets, are developed in such machines, they tend to cool the roller in a narrow zone. Therefore, as the roller is heated in use, certain portions of it, typically its end portions, become substantially hotter than the cooled center area where the smaller sheet development has been taking place. Hence, when a larger sheet, such as a 40 inch blueprint, is developed in such a machine, its edges will not be uniformly developed as compared to its center area due to the temperature differential across the length of the roller.

In order to eliminate this problem, heat pipes have heretofore been utilized as the developing roller in certain conventional machines. It has been found that such devices will uniformly maintain the temperature across the entire length of the roller to within ½° C under all conditions generally experienced in use. Unfortunately, certain significant drawbacks which will be discussed in detail below have been associated with the use of such devices.

generally speaking, a heat pipe is a closed, evaccuated chamber having its inside walls lined with a capillary structure, or wick, that is saturated with a volatile fluid. The operation of a heat pipe combines the principles of vapor heat transfer and capillary action. Vapor heat transfer is responsible for transporting the heat energy from the evaporator (hot) section of the pipe to the condenser (cool) section of the pipe. Capillary action is responsible for returning the condensed working fluid back to the evaporator section to complete the cycle. In operation, a heat pipe tends to be a nearly isothermal, uniform temperature device capable of carrying heat as much as several hundred times as well as the best metal conductors. The theory and operation of the heat pipe is described in detail in an article entitled "The Heat Pipe" by G. Yale Eastman appearing in the May 1968 issue of SCIENTIFIC AMERICAN, Vol. 218, No. 5, pp. 38–46.

However, utilizing a heat pipe as the developing roller in a reproduction machine has several drawbacks. For example, since a heat pipe is a closed device, the heating means must be located external to it within the machine, thereby presenting the heat loss problems generally associated with such an arrangement. In addition, utilizing a heat pipe as the developing roller is quite expensive as compared to conventional rollers due to the large diameter which is both necessary and desirable for such rollers.

The present invention eliminates these drawbacks found with conventional heat pipe developing rollers by utilizing a small diameter heat pipe which is mounted in contact with the inner wall of a hollow developing roller. It is believed that the developing roller of the present invention will maintain the temperature across its length within limits which permit uniform copy development under all conditions generally experienced in use and at a cost substantially less than with a heat pipe developing roller of an equivalent diameter and length.

DESCRIPTION OF THE PREFERRED EMBODIMENT

Figure 1:
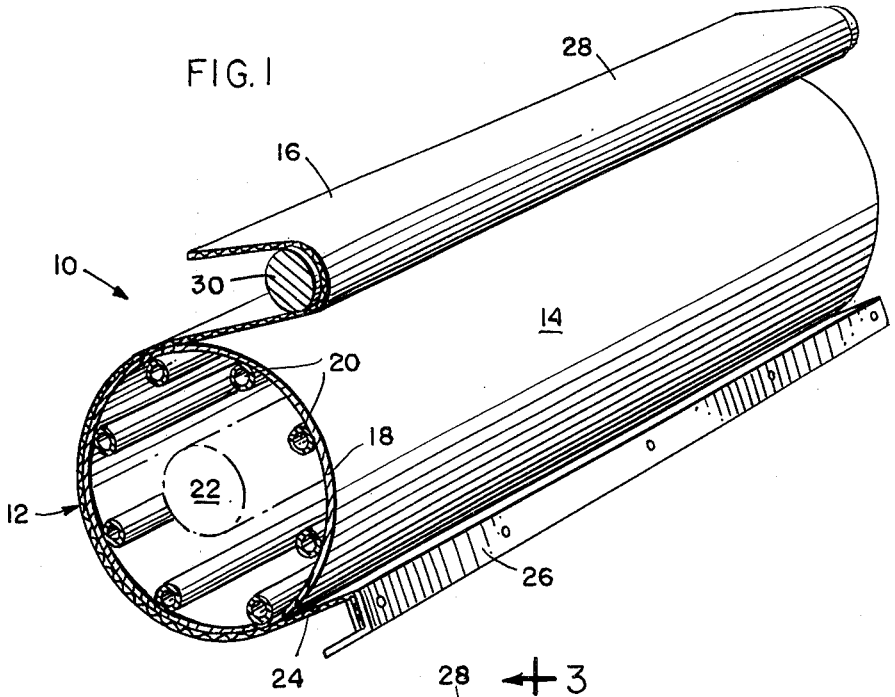
FIG. 1 is a partial, perspective view of developing roller apparatus constructed in accordance with an embodiment of the present invention.

Referring to the drawings, an embodiment of a developing roller apparatus 10 is illustrated which has been constructed in accordance with the present invention. The apparatus includes an image-developing section 12 comprising a cylinder or drum 14 of approximately 12 inches in diameter and a perforated stationary belt 16 which is wrapped about slightly more than half of the outer surface of the cylinder in order to provide a bight portion in a light, sliding contact therewith.

Figure 2:
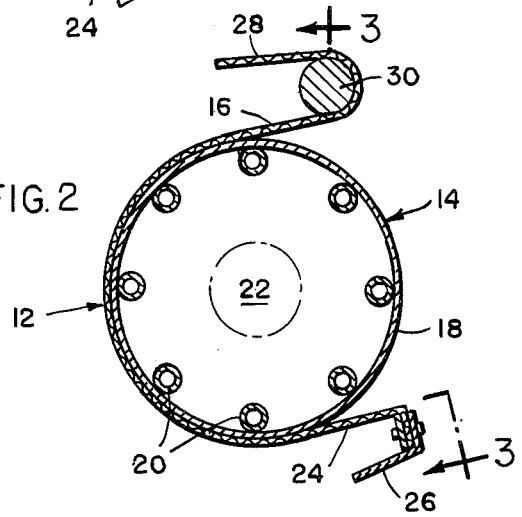
FIG. 2 is a side view of the apparatus shown in FIG. 1.
Figure 3:
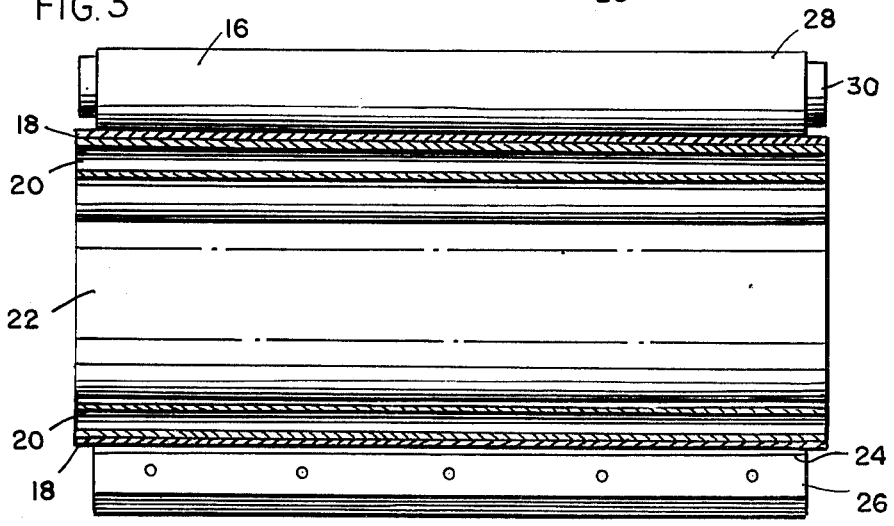
FIG. 3 is a front sectional view taken along line 3—3 of FIG. 2.

Cylinder 14 is supported in the reproduction machine in a conventional manner (e.g., by peripherally spaced idler wheels coacting with flanges on each end of the cylinder) and is rotatably driven in a counterclockwise direction as viewed in FIGS. 1 and 2 by a suitable motor means, both of which have not been shown in order to simplify the illustration of the present invention.

The cylindrical wall 18 of the cylinder 12 may be constructed of thin, heat-conductive metal such as aluminum or steel which presents a large heated surface to the copy sheet carried through the developing section. A series of heat pipes 20 of approximately 5/16 inch diameter, are arranged on or are embedded in the inner wall periphery of the cylinder and extend fully between its ends. The arrangement of such heat pipes within the cylinder is a matter of cost and manufacturing expedency. For example, a suitable embodiment could be constructed utilizing only one heat pipe which could be suitably coiled about the inner wall of the cylinder.

Also illustrated in the drawings is a heating means 22 extending coaxially through the hollow interior of the cylinder. The heating means may consist of a tube containing an element which emits radiant heat which evenly heats the cylinder and heat pipes. The placement of the heating means within the interior of the cylinder allows for very efficient and even heating thereof since there can be little heat loss with such an arrangement.

Belt 16 has one of its ends 24 rigidly attached by bracket 26 to the machine and the other end 28 is wrapped around a roller 30 beyond which it is resiliently attached to the machine (not shown).

In operation, exposed copy paper is fed by a suitable means into the nip between rotating cylinder 14 and belt 16 where the tension in the belt is sufficient to cause the leading edge of the copy paper to be frictionally engaged by the outer surface of the cylinder. The copy paper is then conveyed through the developing section 12 between the cylinder and the bight portion of the belt and is thusly held in light contact with the cylinder. In the course of such travel through the developing section, the heated wall 18 of the cylinder sufficiently raises the temperature of the coating on the copy paper to cause the permanent images to be formed thereon.

Due to the excellent isothermal characteristics of the heat pipes mounted on or embedded in the inner surface of the cylinder, the temperature across the entire surface of the cylinder in the developing section is maintained at a nearly constant level under all conditions found in use. Such efficient heat dispersion across the surface of the cylinder also results in a significant reduction in the thermal output demanded of the heating means 22.

While several particular embodiments and features of the present invention have been shown and described above, it should be understood that various changes and modifications thereto may be made, and it is therefore intended in the following claims to include all such modifications and changes as may fall within the spirit and scope of this invention.

What is claimed is:

1. A developing roller for use in the development of heat-sensitive copy sheets in a reproduction machine, said roller comprising:

a hollow, thin-walled heat conducting cylinder rotatably mounted in the reproduction machine;

a plurality of relatively small diameter heat pipes mounted along the inner wall of said cylinder between its ends; and a means for heating said cylinder and heat pipes located within the hollow interior of said cylinder.

2. The roller of claim 1 wherein said heat pipes are embedded in said inner cylinder wall.

* * * * *